US007106187B2

(12) United States Patent
Penney et al.

(10) Patent No.: US 7,106,187 B2
(45) Date of Patent: Sep. 12, 2006

(54) FIRE DETECTOR

(75) Inventors: Steve J. Penney, Middlesex (GB); Paul J. Taylor, Surrey (GB)

(73) Assignee: Thorn Security Limited, London (GB)

( * ) Notice: Subject to any disclaimer, the term of this patent is extended or adjusted under 35 U.S.C. 154(b) by 230 days.

(21) Appl. No.: 10/250,929

(22) PCT Filed: Jan. 8, 2002

(86) PCT No.: PCT/GB02/00054

§ 371 (c)(1),
(2), (4) Date: Oct. 22, 2003

(87) PCT Pub. No.: WO02/054366

PCT Pub. Date: Jul. 11, 2002

(65) Prior Publication Data

US 2004/0112114 A1 Jun. 17, 2004

(30) Foreign Application Priority Data

Jan. 8, 2001 (GB) ..... 0100429.0

(51) Int. Cl.
*G08B 29/00* (2006.01)

(52) U.S. Cl. ..... 340/514; 340/628; 73/1.01

(58) Field of Classification Search ..... 340/514, 340/635, 628, 632, 500, 513, 577, 815.42; 73/1.01, 863.31
See application file for complete search history.

(56) References Cited

U.S. PATENT DOCUMENTS

| | | | | |
|---|---|---|---|---|
| 2,877,453 | A * | 3/1959 | Mendenhall, Jr. | 340/630 |
| 3,636,514 | A | 1/1972 | Burgess | 340/147 |
| 4,412,211 | A * | 10/1983 | Lautzenheiser et al. | 340/514 |
| 4,489,312 | A | 12/1984 | Yoshizaki | 340/514 |
| 4,518,952 | A | 5/1985 | Tanaka et al. | 340/514 |
| 4,901,056 | A * | 2/1990 | Bellavia et al. | 340/514 |
| 4,962,368 | A | 10/1990 | Dobrzanski et al. | 340/514 |
| 5,148,158 | A | 9/1992 | Shah | 340/825.17 |
| 5,686,885 | A | 11/1997 | Bergman | 340/514 |
| 5,796,347 | A | 8/1998 | Zulaski | 340/635 |
| 5,818,334 | A * | 10/1998 | Stanley | 340/505 |
| 6,380,854 | B1 * | 4/2002 | Hagerman et al. | 340/540 |
| 6,538,568 | B1 * | 3/2003 | Conley, III | 340/540 |

FOREIGN PATENT DOCUMENTS

| | | |
|---|---|---|
| EP | 0 352 317 B1 | 1/1990 |
| GB | 2 299 886 A | 10/1996 |
| WO | WO 89/06412 A1 | 7/1989 |
| WO | WO 01/78026 A1 | 10/2001 |

* cited by examiner

*Primary Examiner*—Phung T. Nguyen

(57) ABSTRACT

A detector for smoke, heat or the like, which has test function circuitry capable of initiating verification of the detector operation, including testing of a communication path between the detector and a central control unit. The test is actuated on receipt of a signal initiated at the detector, which indicates success by illuminating the detector's LED. An operator is able to initiate the test by means of a laser pointer.

11 Claims, 7 Drawing Sheets

FIRE DETECTOR

This is a U.S. national phase application which is based on, and claims priority from, PCT application Serial No. PCT/GB02/00054, filed on Jan. 8, 2002, which itself claims priority from foreign application Serial No. 0100429.0, filed on Jan. 8, 2001 in the United Kingdom.

The present invention relates to a fire detector, and in particular to a fire detector having a self-test function.

It is quite common for a building to incorporate a system of ceiling detectors for the detection of heat and smoke. The three types of detectors most commonly used are heat detectors, optical smoke and heat detectors, and ionisation smoke detectors. In many installations detectors are electrically connected to central Control and Indicating Equipment (CIE), where they are monitored.

Although each detector may have a functional test initiated by CIE, in some markets, in order to increase user confidence that detectors are being regularly tested, there is the requirement that the test be initiated local to that detector, by an operator, for example a Service Engineer.

Detectors with a push button switch or which are magnetically operated to initiate a test function within the associated detector circuitry are known. The majority of fire detectors within buildings are ceiling mounted. As such, it is difficult for a person to reach such detectors in order to initiate testing at the detector.

A smoke or flame detector having self-test circuitry capable of being initiated remotely, by a source of radiant energy being directed at a sensor, is disclosed in European patent application EP 0352317. The detector therein disclosed provides for a test condition in response to, and for as long as, the test initiating signal (for example a flash-light or torch) is detected.

The use of a simple light source for providing the initiating signal, allows an unauthorised person to initiate the test mode on a given detector. Furthermore, a light pulse mechanism, such as, for example, a strobe light, directed over the sensor may be sufficient to initiate the test mode. This may be disadvantageous, particularly when a large number of detectors are linked to a single control system, or to a plurality of control systems, where it is important to test whether a given detector is working in conjunction with the entire system, rather than simply working as an individual unit. It may, therefore, be preferable for initiation of the test function to be restricted to a service engineer, who is able to test every detector, in conjunction with the system, in an organised and methodical way to make sure that the entire system is working correctly.

The present invention seeks to alleviate the aforementioned disadvantages with known detectors by providing a detector for smoke, heat or the like, which has test function circuitry capable of initiating verification of the detector operation, including testing of a communication path between the detector and a central control unit. The test is actuated on receipt of a signal initiated at the detector, which indicates success by illuminating the detector's LED. In the present invention, an operator is able to initiate the test by means of a laser pointer, or similar source of collimated light.

The test is initiated by a laser beam movement over a means of detection. A test verification sequence is performed when light from the laser beam movement is converted into an intelligent electrical signal which can be communicated to the CIE. At the same time the modulated signal tests the communication path to the CIE.

Accordingly, there is provided a fire detection system comprising at least one detector and a central control unit, the or each detector having an indicator for indicating a status condition at the detector, and a light detecting transducer for sensing a trigger signal for initiating a test of the detector for determining its status, the central control unit being in communication with the or each detector for sending a signal to actuate the light detecting transducer of that detector so as to be receptive to said trigger signal, and for receiving an information signal from that detector regarding its status.

Preferably, the light emitting diode constitutes both the indicator and the transducer, the light emitting diode having a forwards-biased mode in which it acts as an indicator, and a reverse-biased mode in which it acts as a light detecting transducer.

It is preferable that the or each detector is such that the status indicated is whether or not it is in working order, and that the or each detector is such that the status indicated is the operational state of at least part of its internal circuitry.

Advantageously, the or each detector is such that the status indicated is the operational status of a communications channel connecting that detector to the central control unit.

There is also provided, a fire detector comprising an indicator for indicating a status condition at the detector, a light detecting transducer for sensing a trigger signal for initiating a test of the detector for determining its status, a light pipe for transmitting light to the transducer and from the indicator, and control circuitry associated with the indicator and the transducer.

Preferably, the light emitting diode constitutes both the indicator and the transducer, the light emitting diode having a forwards-biased mode in which it acts as an indicator, and a reserve-biased mode in which it acts as a light detecting transducer.

Advantageously, the detector is such that the status indicated is whether or not it is in working order, and the detector is such that the status indicated is the operational state of at least part of its internal circuitry.

It is preferable that the detector is such that the status indicated is the operational status of a communications channel connecting the detector to the central control unit.

Preferably the detector further comprises a second light emitting diode associated with the control, circuitry, the second light emitting diode constituting means for indicating the status of the detector, and the light pipe transmitting light from the second light emitting diode.

There is also provided a fire detector comprising an indicator for indicating a status condition at the detector, a light detecting transducer for sensing a trigger signal for initiating a test of the detector for determining its status, and control circuitry associated with the indicator and the transducer, wherein the transducer is such as to sense only a trigger signal of predetermined characterisation.

It is preferable that the transducer is such as to sense only a trigger signal having a rising edge with predetermined Fourier components.

The present invention will now be described, by way of example, with reference to the accompanying drawings, in which.

Figure 1:
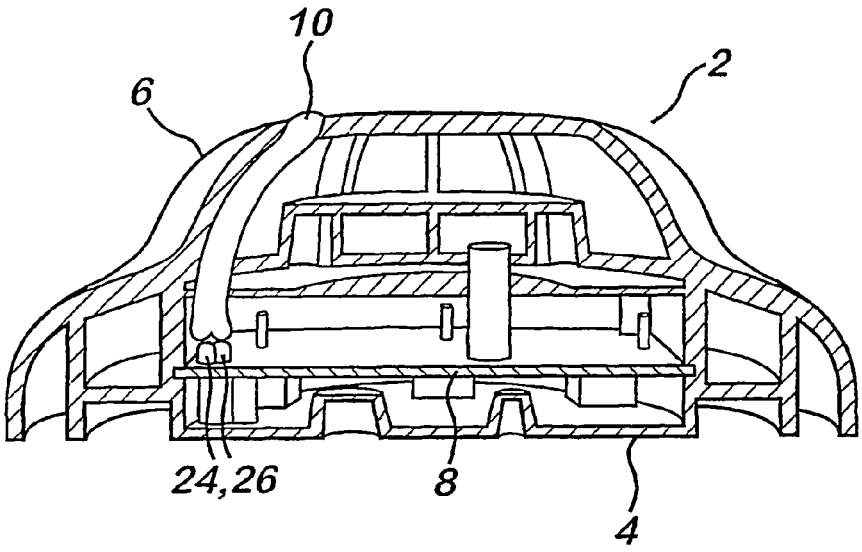
FIG. 1 is a cross-sectional view of a detector constructed in accordance with the present invention.

With reference to FIG. 1, a detector 2 has a common body part 4 which plugs into a universal base. The body part 4 has a surrounding outer cover 6. The body part 4 has a base 8 which holds an infra-red LED and a receiver circuit. Two LEDs (red and green) 24, 26 are mounted on a printed circuit board within the main body 4 of the detector 2. A light pipe 10 stems from the printed circuit board, through the main body 4, and out of outer cover 6, such that light from the LEDs 24, 26 is channelled through the light pipe to outside the detector. Optical lenses (not shown) are also provided to collect light and to transmit it back through light pipe 10, in the opposite direction, to the LEDs 24, 26.

Figure 2:
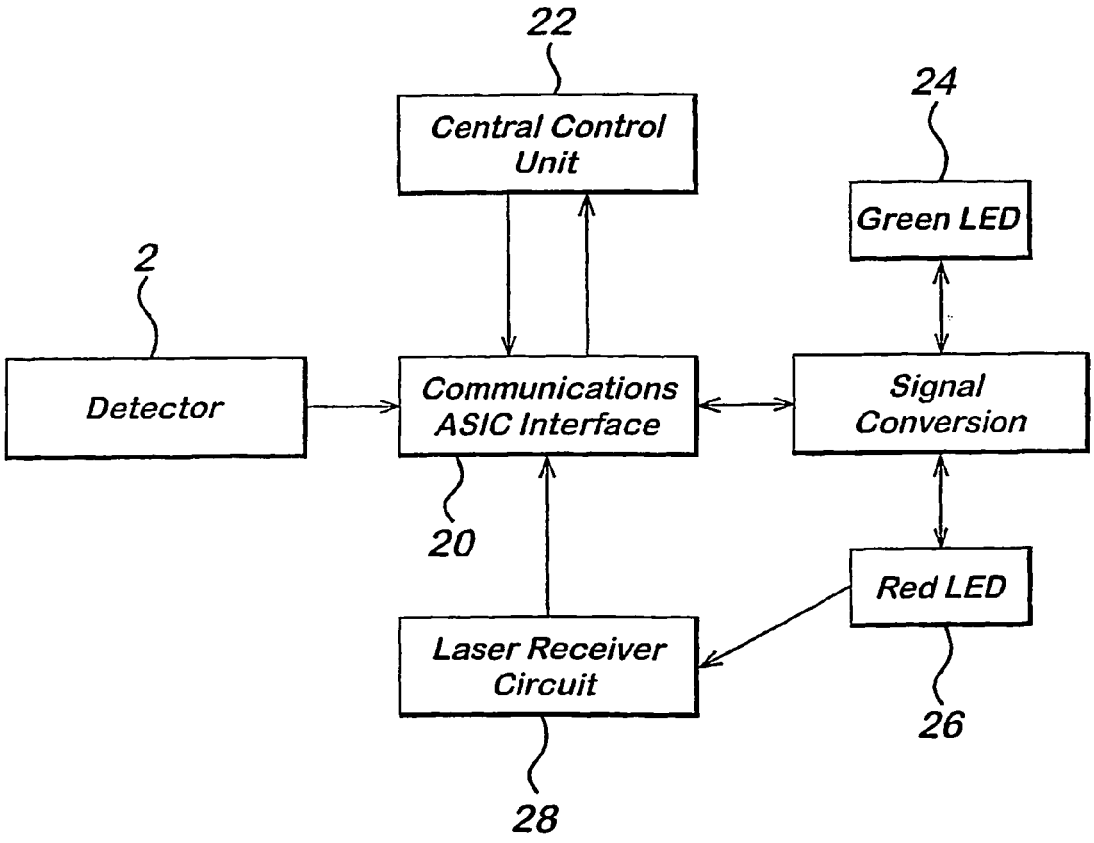
FIG. 2 is a simple block diagram illustrating the basic principle of the overall detection system constructed in accordance with the present invention.

Reference is now made to FIG. 2, which illustrates the basic principle of the overall detection system. Although the system provides for a plurality of detectors 2 all linked to a central control, the operation of only one detector 2 will be described hereinafter. The detector 2 includes a heat element, an optical sensing unit or an ionisation chamber, depending on whether the detector is a heat detector, an optical smoke and heat detector or an ionisation detector respectively. The detector 2 is linked to a communications applications specific integrated circuit (ASIC) interface 20. The interface 20 is, itself, linked to a central control unit 22 which controls the operation of the (and every other) detector 2. Analogue signals sent from the detector 2 to the interface 20 are filtered and converted, before being sent to an appropriate green LED 24, or red LED 26, to provide a "working" signal (the green LED 24) or a "fault" or "alarm" signal (the red LED 26). Furthermore, the red LED 26 is able to act in a reverse biased mode, when actuated by a signal from the central control unit 22 via the interface 20. In such a mode, the red LED 24 acts as a laser detection transducer for a laser receiver circuit 28.

The present invention can be utilised by a number of types of detector, including heat detectors, optical smoke detectors, and ionisation detectors. Although these detectors operate differently, the test circuitry is common to each detector. Such circuitry is now described with reference to FIG. 3.

Figure 3:
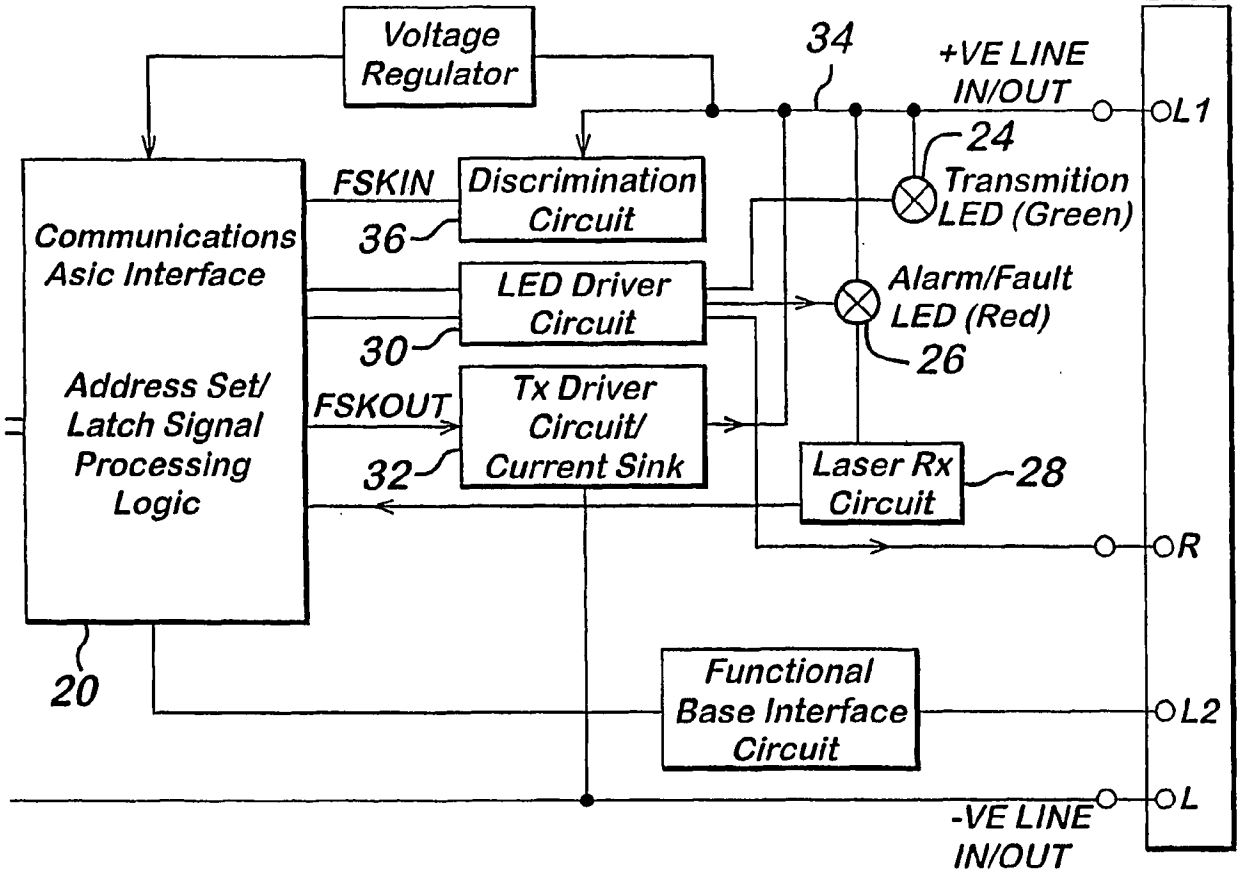
FIG. 3 is a simplified block schematic of the circuit of FIG. 2.

Referring to FIG. 3, the interface 20 includes a decoder to decode a signal received from the detector 2. The detector 2 is addressed via a loop address protocol. When the correct address is decoded via detector signal processing and logic circuits within the interface 20, the analogue signals of the detector elements are converted to digital values which are then transmitted to the central control unit 22 (not shown in FIG. 3). The signal, sent from the interface 20, is also sent to an LED select port 30, and then to the green LED 24 or the red LED 26 within the detector 2, depending on the signal received by the LED mode select port.

The decoded digital signal sent by the interface 20 is also passed to a "Tx Driver Circuit/Current Sink" 32 which applies the signal to a positive line 34 for transmission to the central control unit 22 (not shown in FIG. 3).

Under normal standby conditions, the green LED 24 flashes periodically. When an alarm threshold is exceeded, an alarm is triggered at a control panel of the central control unit 22. The red LED 26 then lights up steadily. Under fault conditions, the red LED 26 flashes.

Communications between the central control unit 22 and the detector 2 (via the interface 20) use the standard Frequency Shift Keying (FSK) method. A signal sent from the central control unit 22 via the positive line 34 is first trasmitted to a "discrimination circuit" 36 which filters the FSK signal from the positive line voltage, and converts it to a digital square wave input for transmission to the interface 20.

In the aforementioned description, the red LED 26 operates in forward biased mode (photo-emissive mode), thereby acting as a red light emitting diode. As mentioned briefly above, the central control unit 22 can, via the interface 20, alter the circuit, as described below, to operate the red LED 26 in a reverse biased mode (photoelectric mode), thereby making it act as a laser detection transducer for the laser receiver circuit 28.

Figure 4:
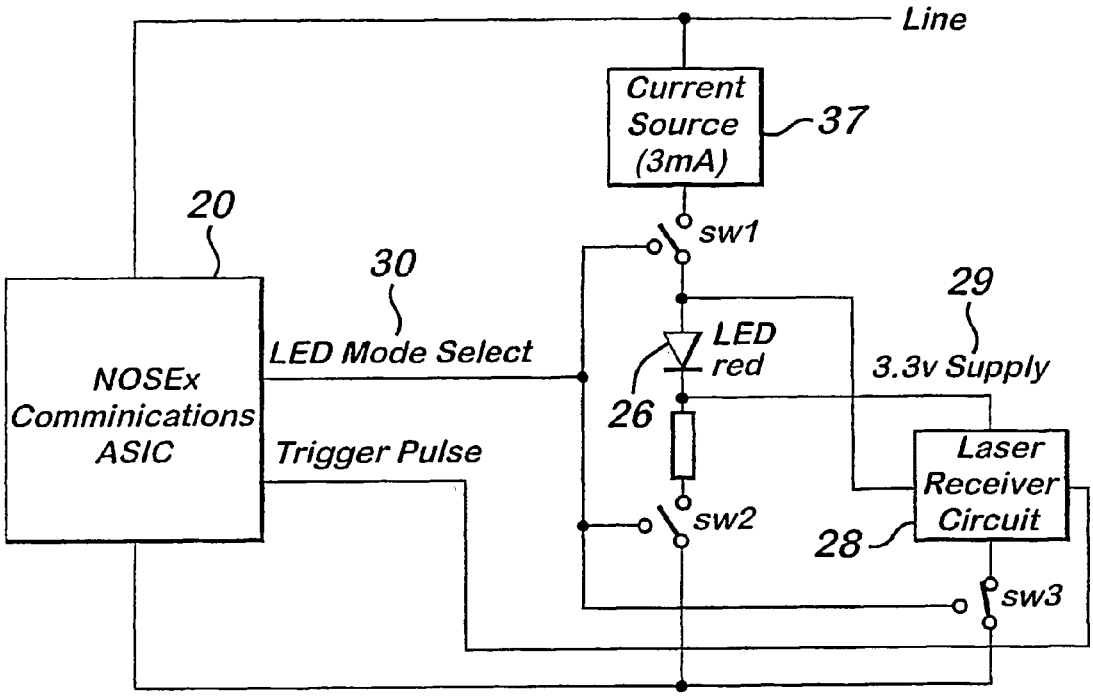
FIG. 4 is a simplified block schematic of the circuitry.

FIG. 4 is a simplified block schematic of the circuitry showing how the red LED 26 can alternate between its two operable states. Thus, as shown in FIG. 4, the operable mode of the red LED 26 is controlled by switches SW1, SW2 and SW3. All three switches SW1, SW2 and SW3 are controlled by the LED mode select port 30 that, in turn, is controlled by the interface 20.

The first mode of operation is when the red LED 26 acts, in its normal state, as a light emittting diode. In order to do so, the LED 26 is connected to a 3 mA constant current source 37 in the forward biased mode, while the switches SW1 and SW2 are closed and the switch SW3 is open.

The second mode of operation, known as a "walk test mode", is when the red LED 26 acts, in a reverse biased mode, as a laser detection transducer. When the red LED 26 is required to operate in the walk test mode, the switches SW1 and SW2 are open and the switch SW3 is closed. In this mode, the central control unit 22 (not shown in FIG. 4) enables the red LED 26, acting as a sensor, to return digital interrupts through the interface 20. Digital interrupts occur when the laser receiver circuit 28 has been enabled, via the switch SW3, and the red LED 2 is connected across a 3.3 volt supply 29 in its reverse biased mode.

The red LED 26, acting as a photo-detector, incorporates therewith a visible red laser beam receiver circuit 28 capable of detecting a small change (for example, a reverse current) across the photo-detector of the laser receiver circuit. During the walk test mode, a visible red laser beam produced by an "off the shelf" laser pointer (not shown) is aimed at the sensor (the red LED 26), by a service engineer specifically aiming the pointer at the light pipe constructed within the detector 2. When the sensor 26 recognises the laser beam light, it sends up to fifteen digital interrupts back to the central control unit 22 (the digital interrupts are enabled by the central control unit). Each time an interrupt is sent to the central control unit 22, the green LED 24 flashes.

Once an interrupt has been acknowledged, the central control unit 22 immediately switches on the red LED 26 to indicate the acknowledgement.

Figure 5:
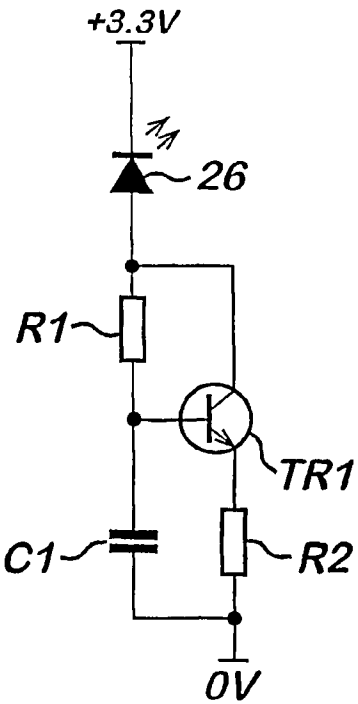
FIG. 5 is a simplified circuit diagram of a front-end laser detection circuit forming part of the circuitry.

The front-end of the laser receiver circuit 28 is now described with reference to FIG. 5, the circuit being tuned to respond to a laser signals greater than 0.72 Hz. A collector resistor R1 is associated in parallel with a capacitor C1 to form a first order single pole high pass cut-off filter.

When ambient background light falls upon the red LED 26, current generated therefrom flows through the resistor R1 to the base of a current generator transistor TR1. The transistor TR1 conducts as a result of the current flowing therethrough and, in doing so, shunts the current directly to the negative supply, thereby reducing the base drive to the transistor. An equilibrium point is reached when the transistor base current holds the collector voltage at 100 mV, by acting as a constant current generator that exactly matches the current fed by the red LED 26. This equilibrium is supported for slowly varying current or direct current, hence providing a low output impedance load.

The capacitor C1, which is connected to the base of the transistor TR1, slows down the speed at which the load circuit responds to sudden changes in current over the red light emitting diode 26. The current match equilibrium of the active load cannot be maintained for fast changing currents, greatly increasing the output impedance.

The voltage gain given to a signal generated on the base emitter circuit of the transistor TR1 is calculated by dividing the collector resistance of R1 by the intrinsic emitter resistance plus the resistance of a resistor R2. Hence:

$$\text{Gain}=Rc/re+Re$$

where re=25/Ie (mA)

Re=the resitance of R2 and Ie=the current flowing through resistor R2

The resistor R2 connected to the emitter of the transistor TR1 reduces the overall gain of the circuit, which improves stability, whilst limiting the noise and interference produced by ambient light, direct sunlight or circuit interference.

Figure 6:
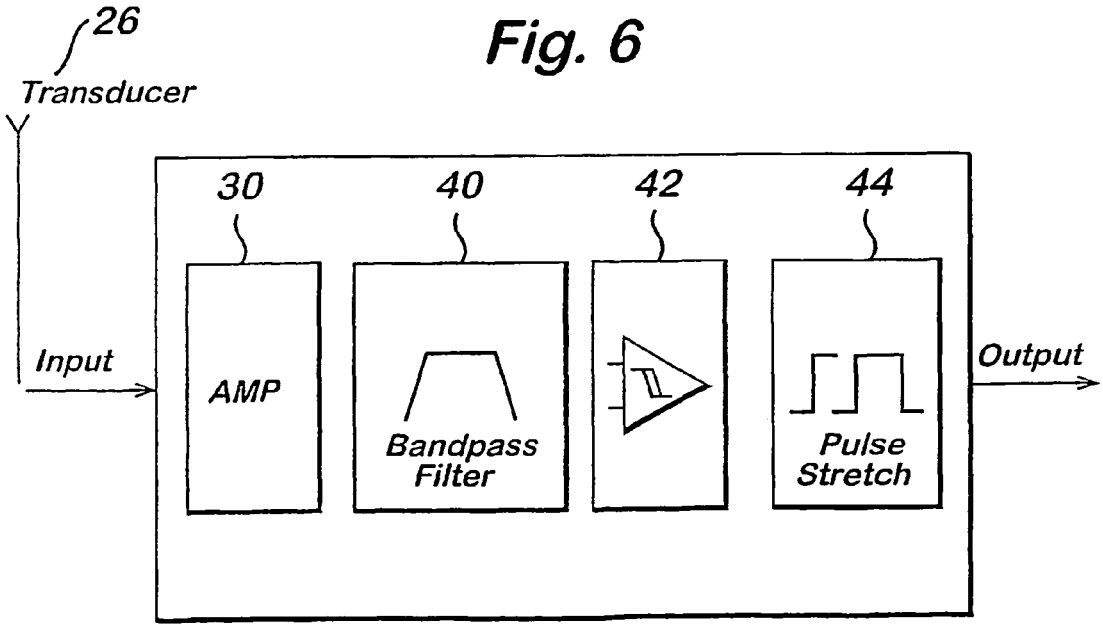
FIG. 6 is a simplified block diagram of the laser detection circuit of FIG. 5.

FIG. 6 is a simplified block diagram of the front-end laser detection circuit, which consists of a laser transducer (the red LED 26), an amplifier 38, a bandpass filter 40, a Schmitt comparator 42 and pulse stretch circuits 44.

Figure 7:
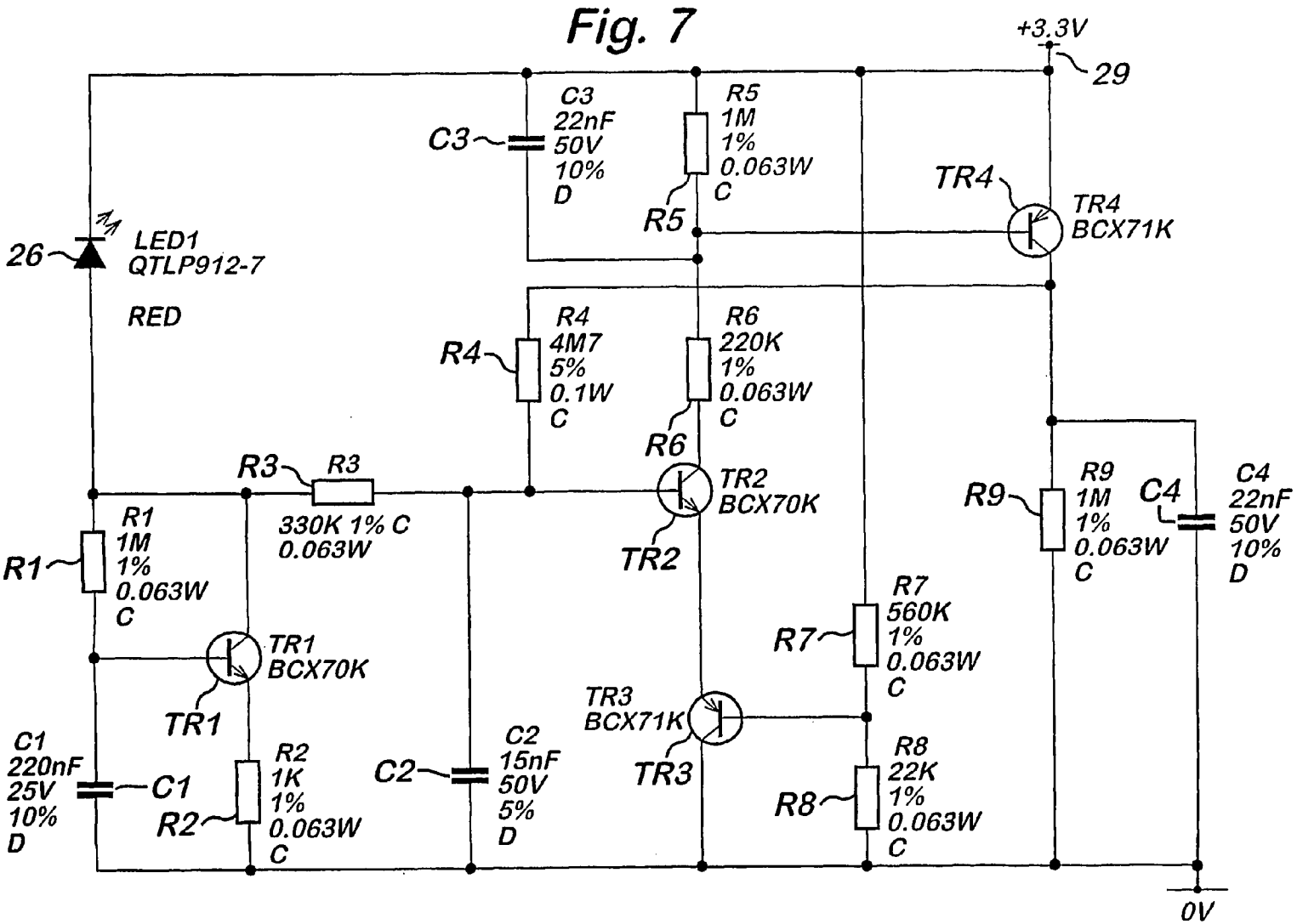
FIG. 7 is a circuit diagram for the entire laser detection circuit of FIGS. 5 and 6.

The entire laser receiver circuit can be seen in FIG. 7. The red LED 26, connected in reverse biased mode, is connected in series with the active load consisting of the transistor TR1, the resistors R1 and R2, and a capacitor C12, across a 3.3 volt dc supply 29. When LED 26 is modulated by laser signals, currents produced, become voltage transposed across the load. The active load is designed to produce optimum load characteristics of high impedance at high frequencies and low impedance at dc or low frequencies. A resistor R3 and a capacitor C2 comprise a single pole low pass filter that attenuates the high frequency components of high intensity flashing lights such as xenon strobe lights, which could falsely trigger the circuit.

The circuit is tuned to respond to an ac signal that is within the bandpass response of a particular filter characteristic. The resistor R1 and the capacitor C1 determine a first cut-off frequency at 0.72 Hz, and the resistor R3 and a capacitor C3 determine a second cut-off frequency at 32 Hz, thereby optimising the traverse linear movement of a laser beam across the receiver LED 26 to 10 m/s.

The conditioned signal voltage generated on the base of a transistor TR2 represents the laser signal, which gets compared to a reference voltage of 1.2 volts generated by a transistor TR3 and resistors R7 and R8.

A resistor R4 is included, to provide positive hysteresis feedback providing true Schmitt trigger comparative levels. When the amplified signal is greater than 1.2 volts, transistor TR4 turns on, having the affect of charging a capacitor C4 to 3.3 volts. The capacitor C4 temporarily holds the voltage into a stored charge, effectively acting as a pulse stretch circuit 44. The pulse stretch circuit 44 increases the output trigger signal duration for digital input recognition by the interface 20.

A general description of how the detection system works, when connected to a control panel is as follow:

From the control panel, an operator initialises "walk test mode" for one or more detectors 2 linked to the overall system. The operator may want to test a single detector 2 or, alternatively, may want to test an entire floor of a building. The instructing data is sent to the interface 20 of each detector 2. Once an instructing signal is recognised, the interface 20 of each detector 2 actuates the walk test mode on that detector by altering the detector circuit (using the switches SW1, SW2 and SW3) to place the red LED 26 of each actuated detector 2 into its reverse biased mode, thereby enabling that LED to act as a laser detection transducer to a laser receiving circuit 28.

A service engineer is then able to walk around the building directing a laser pointer at each actuated detector 2 in turn, thereby initiating the test procedure of that detector. The test procedure is actuated by the detection of movement of the laser beam over the laser receiver circuit 28. The light pipe within each detector 2 channels the laser beam through to the red LED 26, where the detection of the laser beam occurs. Once an initiation signal has been received, on detection of a laser beam, the green LED will flash to provide a visual indication to the service engineer that the testing procedure has started. The light pipe is bi-directional such that, when the red LED 26 is in photoelectric mode, light travels through the light pipe in the opposite direction to that of coloured visual indicating light.

When the controller receives a signal from the sensor, it signals back an instruction o illuminate the detector LED, providing a visual indication if the detector 2 is working correctly. The test is logged at the controller.

Figure 8:
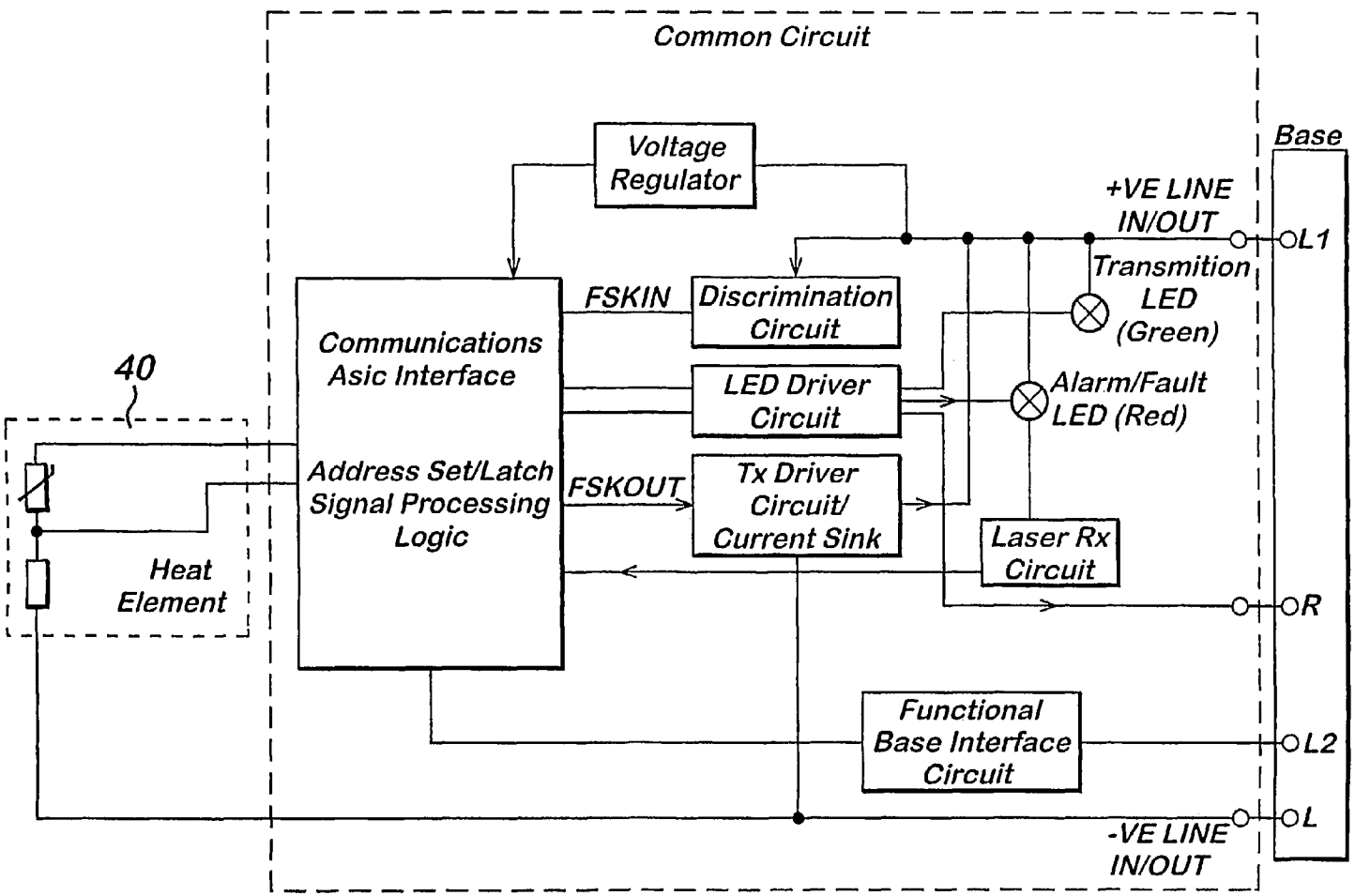
FIG. 8 is a simplified block circuit diagram for a heat detector.
Figure 9:
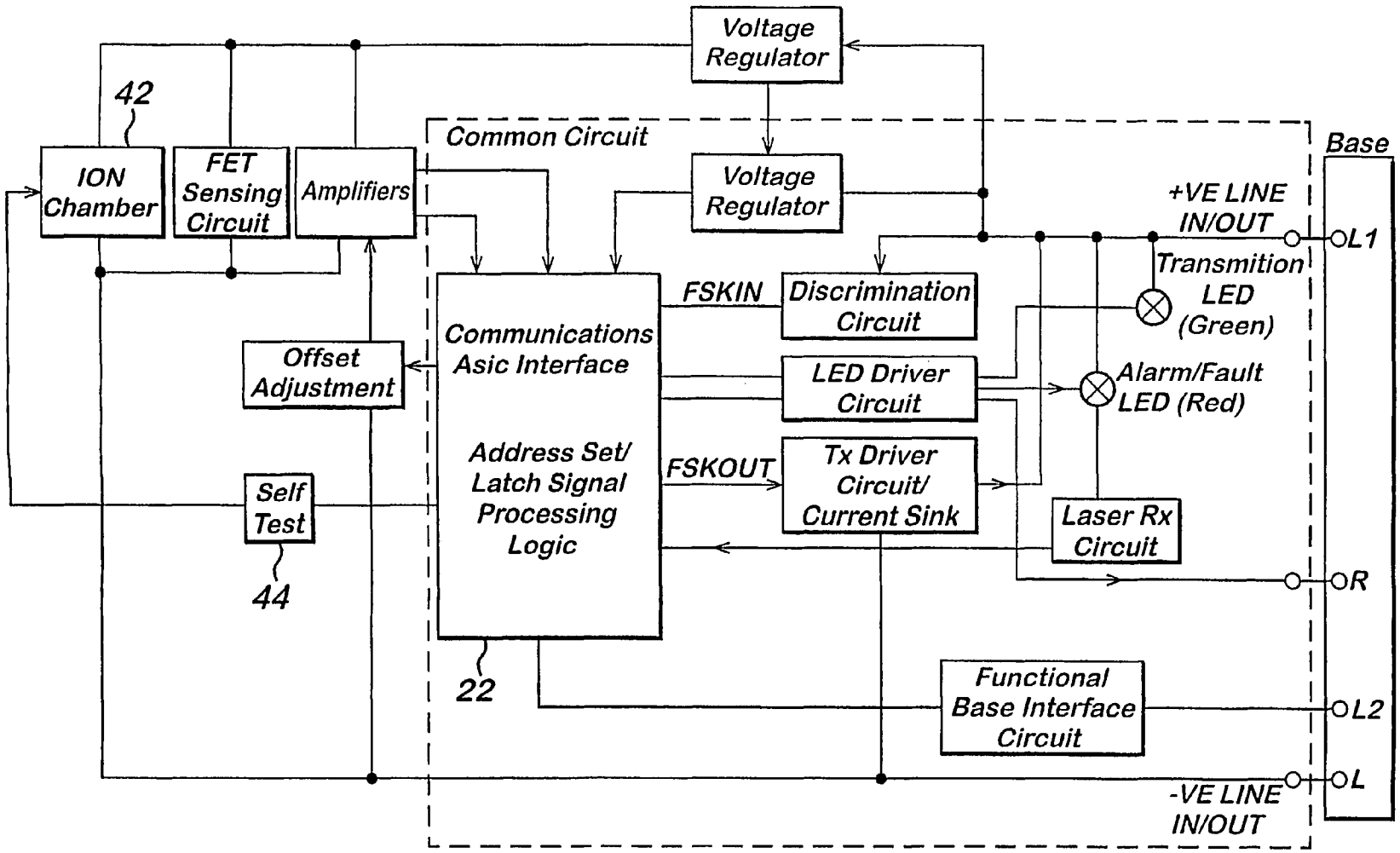
FIG. 9 is a simplified block circuit diagram for an ionisation smoke detector.
Figure 10:
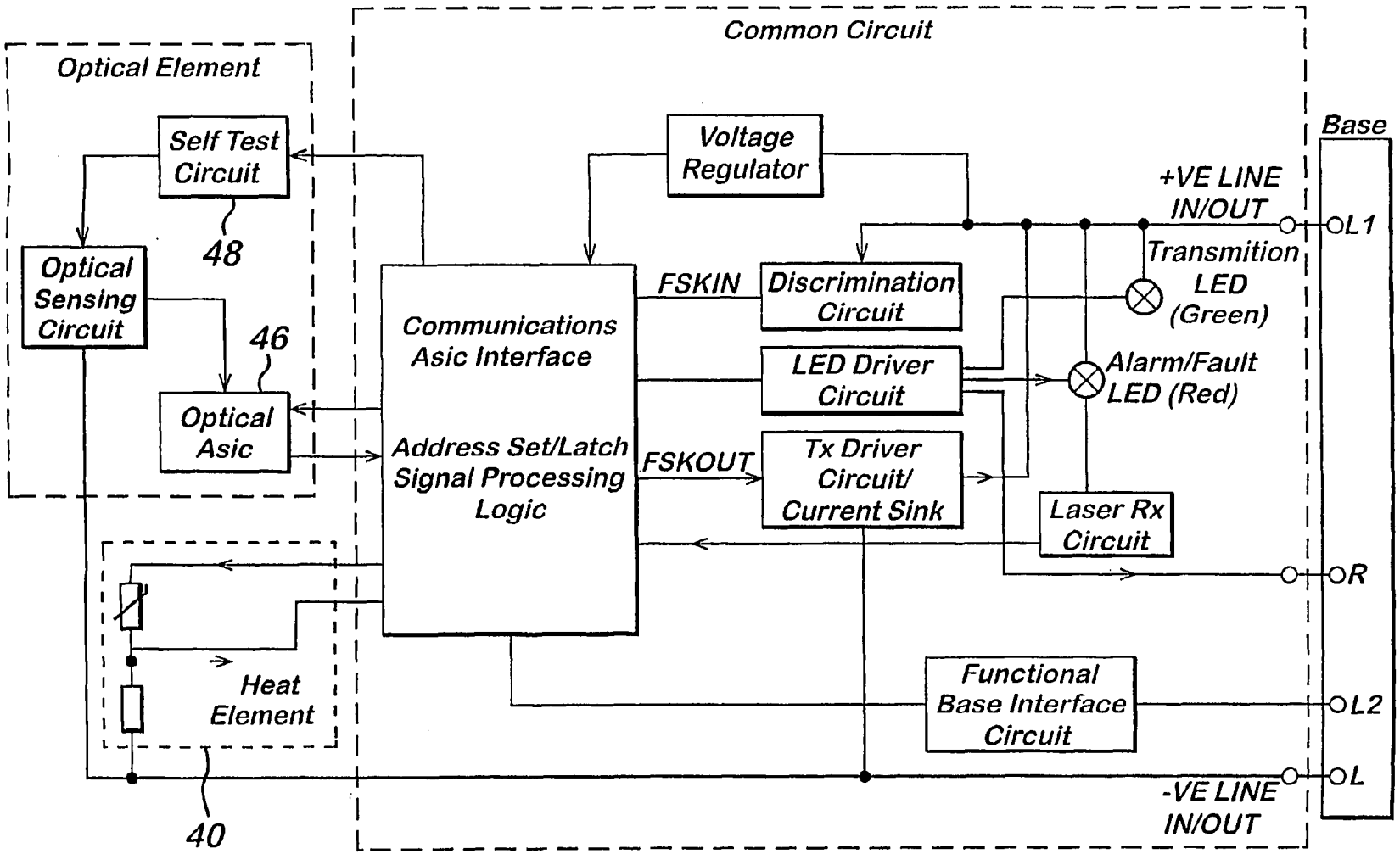
FIG. 10 is a simplified block circuit diagram for an optical smoke and heat detector.

As previously explained, the test circuitry of the present invention can apply to different types of detectors. FIGS. 8, 9 and 10 show the overall circuit for a heat detector, an ionisation smoke detector and an optical heat and smoke detector respectively. In each case the test circuitry hereinbefore described is common to all the detectors, consequently, only the differences outside said circuit are now described with reference to the Figures.

Referring first to FIG. 8, the circuit for a heat detector further comprises a heat element 40. The heat element 40 uses a single thermistor (not shown) to produce an output proportional to temperature. The rate of change of temperature is calculated by the central control unit 22 (not shown in FIG. 8).*using* consecutive temperature values sent to the central control unit from the detector's thermistor. The thermistor is a negative temperature coefficient thermistor that produces an analogue output which is fed to the interface 22 for processing.

The ionisation smoke detector circuit of FIG. 9 includes an ionisation chamber 42 to detect the presence of aerosol combustion products generated in a fire. The air within the chamber 42 is ionised by the addition of a small radioactive source (<33.3 kBq of Americium 241) within the volume enclosed by a slotted outer cover (not shown). The ionisation causes a small current to flow between the source and the outer cover which then has a fixed voltage applied between them. Ionised air within the chamber 42 is affected by the aerosol combustion products such that an imbalance occurs, increasing the voltage potential.

The circuit of FIG. 9 also has a "self-test" facility 44 which alters the ionisation chamber voltage 42 electronically, on request by the central control unit 22, in order to simulate the response to smoke. The self-test facility can be utilised during the walk test mode.

The optical smoke and heat detector circuit of FIG. 10 includes an optical application specific integrated circuit ("optical ASIC") 46. The optical element includes an optical chamber containing, an emitter and a photodetector (all not shown), the emitter is pulsed every time the detector 2 is polled from the central control unit 22. The optical signal received by the photodetector is fed to the optical ASIC 46. The optical signal is proportional to the scatter within the optical chamber. The optical ASIC 46 amplifies the analogue signal which is then fed to the interface 20.

The circuit of FIG. 10 also includes a heat element similar to the one described above 40 of FIG. 8. The "self-test" facility 48 pulses a second infra-red emitter inside the optical chamber into the pulse, when requested by the central control unit 22, in order to produce a signal that simulates an alarm condition. Again, the self-test facility can be utilised during the walk test mode.

The invention claimed is:

1. A fire detection system comprising at least one detector and a central control unit, the or each detector having an indicator for indicating a status condition at the detector, a light detecting transducer for sensing a trigger signal for initiating a test of the detector for determining its status, and an interface for receiving an actuating signal from the central control unit, the central control unit being in communication with the interface of the or each detector for sending a signal to actuate the light detecting transducer of that detector so as to be receptive to said trigger signal, and for receiving an information signal from that detector regarding its status; wherein a light emitting diode constitutes both the indicator and the transducer, the light emitting diode having a forwards-based mode in which it acts as an indicator, and a reverse-biased mode in which it acts as a light detecting transducer.

2. A system as claimed in claim 1, wherein the or each detector is such that the status indicated is whether or not it is in working order.

3. A system as claimed in claim 1, wherein the or each detector is such that the status indicated is the operational state of at least part of its internal circuitry.

4. A system as claimed in claim 1, wherein the or each detector is such that the status indicated is the operational status of a communications channel connecting that detector to the central control unit.

5. A fire detector comprising an indicator for indicating a status condition at the detector, a light detecting transducer for sensing a trigger signal for initiating a test of the detector for determining its status, an interface for receiving an actuating signal from a central control unit for actuating the light detecting transducer so as to be receptive to said trigger signal, a light pipe for transmitting light to the transducer and from the indicator, and control circuitry associated with the indicator and the transducer and the interface; wherein a light emitting diode constitutes both the indicator and the transducer, the light emitting diode having a forwards-biased mode in which it acts as an indicator, and a reserve-biased mode in which it acts as a light detecting transducer.

6. A detector as claimed in claim 5, wherein the detector is such that the status indicated is whether or not it is in working order.

7. A detector as claimed in claim 5, wherein the detector is such that the status indicated is the operational state of at least part of its internal circuitry.

8. A detector as claimed in claim 5, wherein the detector is such that the status indicated is the operational status of a communications channel connecting to detector to the central control unit.

9. A detector as claimed in claim 5, further comprising a second light emitting diode associated with the control, circuitry, the second light emitting diode constituting means for indicating the status of the detector, and the light pipe transmitting light from the second light emitting diode.

10. A fire detector comprising an indicator for indicating a status condition at the detector, a light detecting transducer for sensing a trigger signal for initiating a test of the detector for determining its status and control circuitry associated with the indicator and the transducer, wherein the transducer is constructed so as to sense only a trigger signal having a rising edge with predetermined Fourier component; wherein a light emitting diode constitutes both the indicator and the transducer, the light emitting diode having a forward-based mode in which it acts as an indicator, and a reverse-biased mode in which it acts as a light detecting transducer.

11. A fire detection system comprising at least one detector and a central control unit, the or each detector having an indicator for indicating a status condition at the detector, and a light detecting transducer for sensing a trigger signal for initiating a test of the detector for determining its status, the central control unit being in communication with the or each detector for sending a signal to actuate the light detecting transducer of that detector so as to be receptive to said trigger signal, and for receiving an information signal from that detector regarding its status, wherein a light emitting diode constitutes both the indicator and the transducer, the light emitting diode having a forwards-biased mode in which it acts as an indicator, and a reverse-biased mode in which it acts as a light detecting transducer.

* * * * *